US007681823B2

(12) United States Patent
Chang

(10) Patent No.: US 7,681,823 B2
(45) **Date of Patent: *Mar. 23, 2010**

(54) POSITIONING STRUCTURE OF A SINGLE-PULL REEL

(75) Inventor: Wen-Han Chang, Taipei (TW)

(73) Assignee: Acrox Technologies, Co., Ltd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/400,810

(22) Filed: Mar. 10, 2009

(65) Prior Publication Data

US 2009/0166462 A1 Jul. 2, 2009

Related U.S. Application Data

(63) Continuation-in-part of application No. 11/843,659, filed on Aug. 23, 2007, now abandoned.

(51) Int. Cl.
*B65H 75/48* (2006.01)

(52) U.S. Cl. ..... 242/378.1; 242/378.2; 242/378.3; 242/378.4

(58) Field of Classification Search ..... 242/378, 242/378.1–378.4
See application file for complete search history.

(56) References Cited

U.S. PATENT DOCUMENTS

| | | | | |
|---|---|---|---|---|
| 6,736,346 | B1 * | 5/2004 | Park | 242/378.1 |
| 7,222,811 | B2 * | 5/2007 | Chang | 242/378.1 |
| 7,222,812 | B2 * | 5/2007 | Chang et al. | 242/378.1 |
| 7,490,791 | B1 * | 2/2009 | Yen | 242/378.1 |
| 2009/0101743 | A1 * | 4/2009 | Chang | 242/385.2 |

* cited by examiner

*Primary Examiner*—Sang Kim
(74) *Attorney, Agent, or Firm*—Leong C. Lei

(57) ABSTRACT

A positioning rod structure for a single-pull reel which will be positioned upon pulling out of cord from the reel and will restore to its original position if the cord is pulled for a second time. When the cord is pulled for one round, a positioning of the cord is done, and the pulling of the cord provides multi control of the cord, accordingly, the pulling of cord is precisely controlled.

3 Claims, 5 Drawing Sheets

POSITIONING STRUCTURE OF A SINGLE-PULL REEL

CROSS-REFERENCE TO RELATED APPLICATION

This is a continuation-in-part of the patent application Ser. No. 11/843,659, filed Aug. 23, 2007 now abandoned.

BACKGROUND OF THE INVENTION (a) Technical Field of the Invention

The present invention relates to a reel, and in particular, a reel which allows single positioning of a cord or multiple positioning of a cord.

(b) Description of the Prior Art

Conventional type of positioning a cord within a reel is the application of steel beads. As shown in FIGS. 7 and 8, the reel A10 comprises a front cover A1, a spiral spring A2, a sliding seat A3, a transmission cord A4, a positioning steel bead A5 and a rear cover A6. In this conventional structure, the sliding seat A3 contains the spiral spring to restore the transmission cord A4 to its original position. The steel bead A5 slides within the sliding seat A3 so as to position the cord A4. The bottom section of the sliding seat A3 has a passage A31 so that the steel bead A5 could roll, engage and disengage within the passage A31.

The drawbacks of the conventional reel are as follows:

1. The constant engagement, disengagement and high speed rolling of the steel bead causes wear to the passage. When a gap forms between the passage and the steel bead, the function for engagement is lost.

2. In view of the above, noise will occur when the gap is widened. The precision of engagement and disengagement is depending on the precision of the gap formed between the steel bead and the passage. Due to wear of the passage, precision control may not be possible.

Accordingly, it is an object of the present invention to provide a positioning rod structure for a reel which could mitigate the above-mentioned drawback.

SUMMARY OF THE INVENTION

The primary purpose of the present invention is to provide a single-pull reel which comprises: a bottom cover having a center provided with an axle, said axle having a top end provided with a notch; a top cover configured to engage with said bottom cover; a cord-rotating disc having a top portion, a bottom portion and a center hole, said top portion being provided with a circular flange which is divided into a plurality of sections by a plurality of slots, a clamping member being provided on said top portion of said cord-rotating disc to form a passage between said clamping member and one of said sections and having engaging means at an inner side against said one of said sections, said bottom portion being provided with a railing groove; a spiral spring having an inner end and an outer end, said inner end being engaged with said notch of said axle of said bottom cover, said outer end being bent into a hook to engage with one of said sections of said cord-rotating disc; a cord divided into a first section and a second section by an enlarged block said block having an engaging means engaged with said engaging means of said clamping member, said first section of said cord being wound around said first flange of said cord-rotating disc, said second section of said cord extending out of a hole from said top portion of said cord-rotating disc to said bottom portion of said cord-rotating disc; a positioning structure including a positioning rod and a positioning plate, said positioning plate covering a top section of said positioning rod, said positioning rod having an end provided with a pivot and another end provided with a sliding protruded section, said sliding protruded section, said sliding protruded section being engaged with said railing slot of said cord-rotating disc, two sides of said positioning plate being secured to an inner side of said bottom by two pegs, said positioning plate having a center pivot hole in which is pivotally mounted said pivot of said positioning rod.

The advantages of the present invention are that

1. Wearing process is slow with respect to positioning rod structure, the positioning rod structure of the present invention has a better longevity.

2. Even wear is occurred, the engaging and disengaging function of the positioning rod structure shall never be lost, and in addition, there is no noise problem with respect to the present structure.

3. Disengagement as found in the conventional steel bead type of positioning will not be happened as the positioning rod is swinging to engage and disengage.

4. The cost of operation is low as the engaging and disengaging do not need to be very precise.

5. The operation of the positioning rod structure is simple and convenient.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
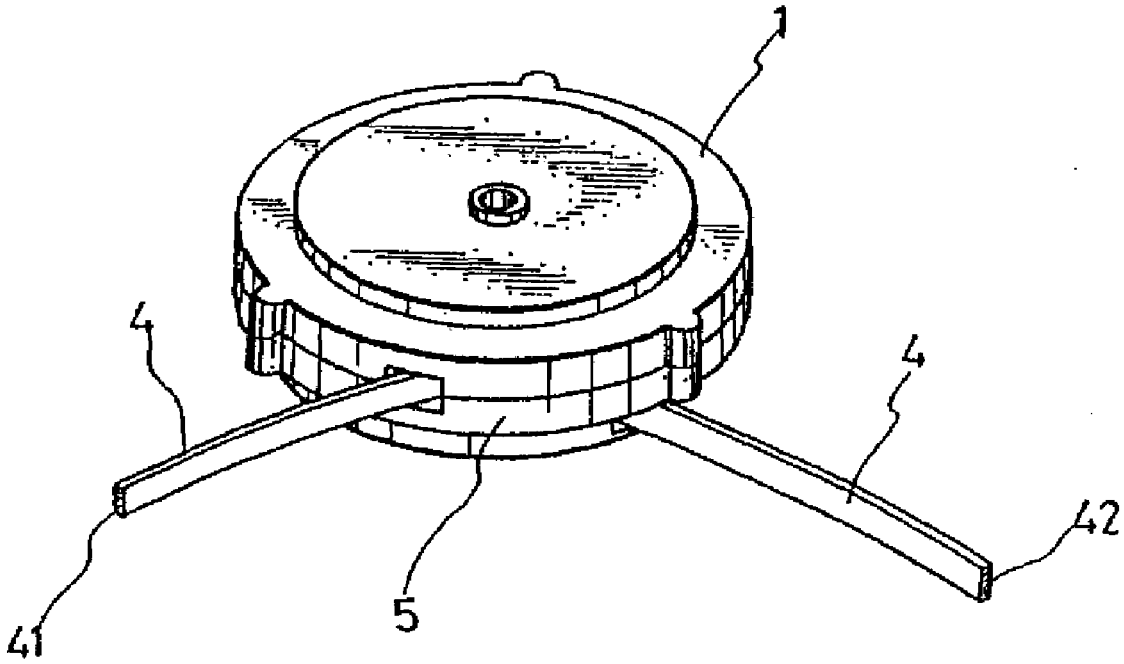
FIG. 1 is a perspective view of a preferred embodiment in accordance with the present invention.
Figure 2:
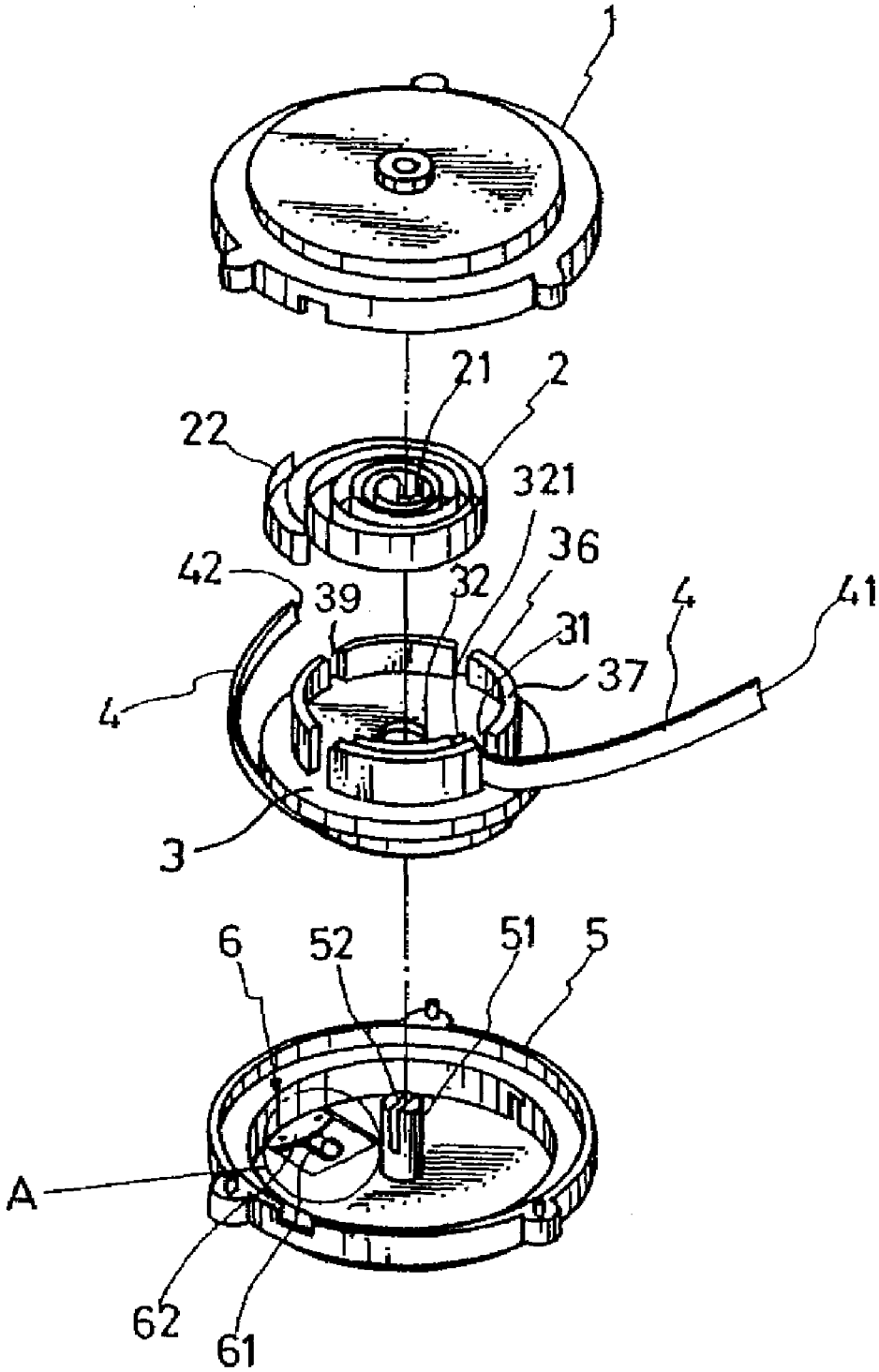
FIG. 2 is an exploded perspective view of the present invention.
Figure 3:
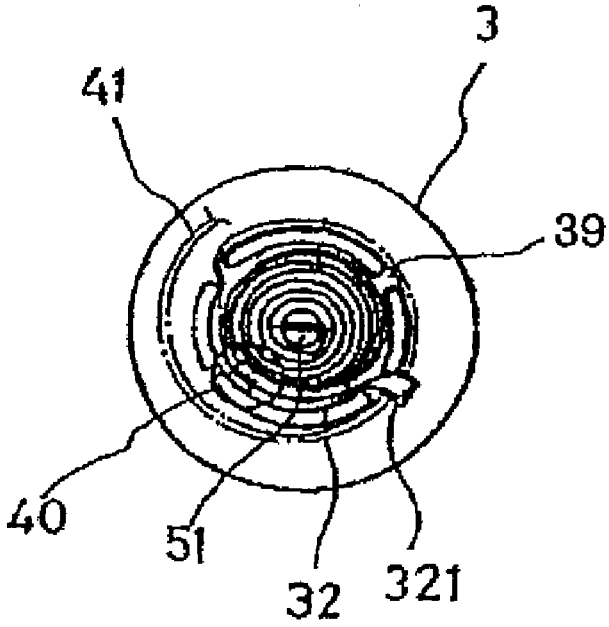
FIG. 3 illustrates the engagement of the spiral spring and the cord-rotating disc.
Figure 4:
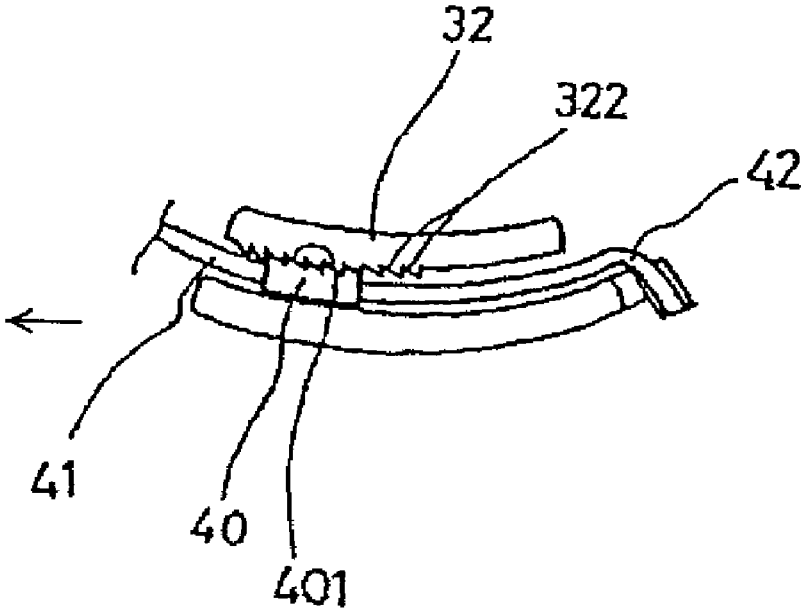
FIG. 4 is an enlarged view of a portion of FIG. 3.
Figure 5:
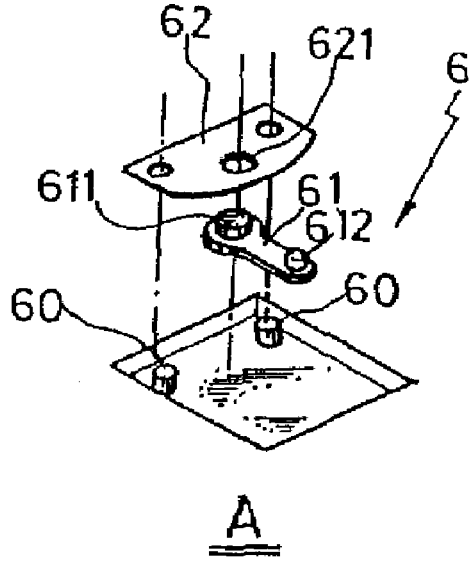
FIG. 5 is an exploded perspective view of the positioning structure, shown as component A in FIG. 2, in accordance with the present invention.
Figure 6:
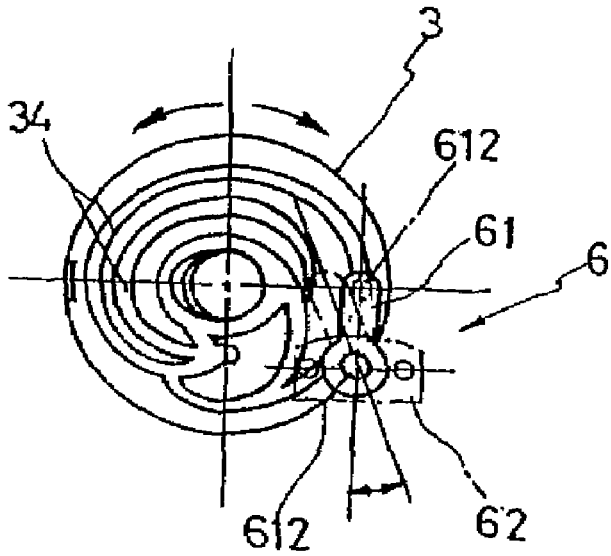
FIG. 6 is a schematic view showing the relative positioning between the positioning rod and the railing groove of the present invention.
Figure 7:
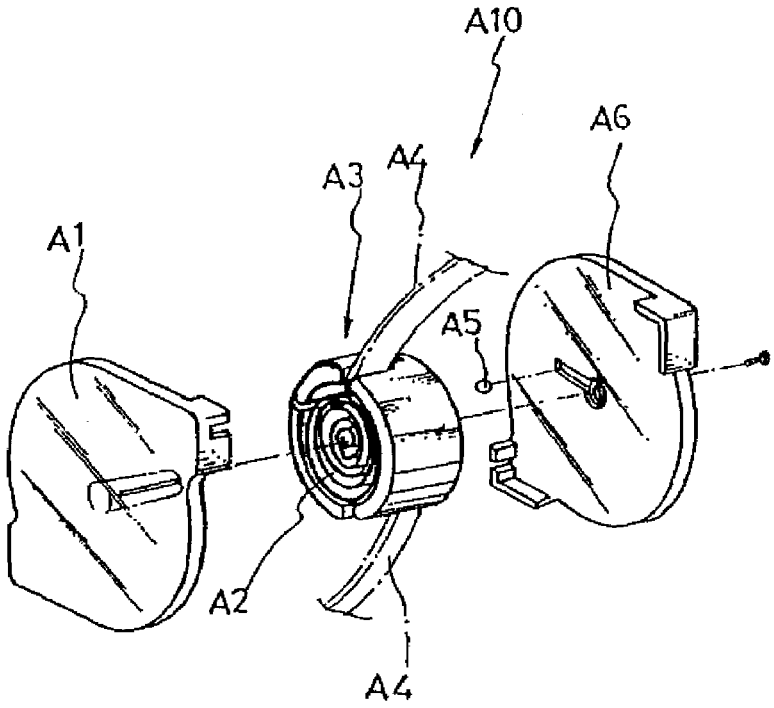
PRIOR ART FIG . 7
FIG. 7 is an exploded perspective view of a conventional reel.
Figure 8:
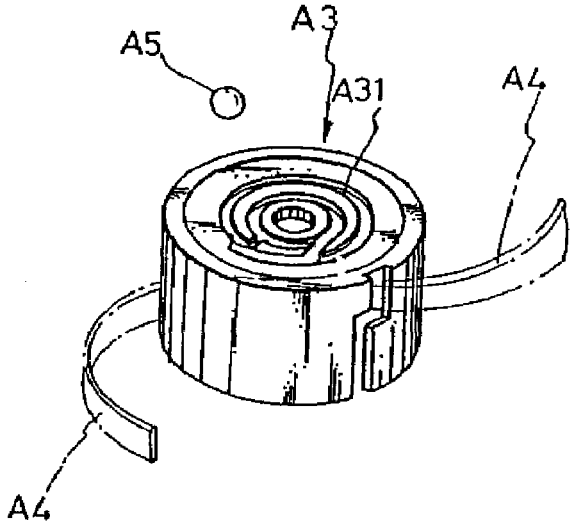
PRIOR ART FIG . 8
FIG. 8 is a schematic view showing the bottom section structure of the sliding seat of the conventional reel employing steel bead for positioning.

Referring to FIGS. 1, 2, 3 and 4, the single-pull reel according to the present invention generally comprises a top cover 1, a spiral spring 2, a cord-rotating disc 3, a cord 4, a bottom cover 5, and a positioning structure 6. The bottom cover 5 is provided at the center with an axle 51 which has a notch 52 at the top end. The top cover 1 is configured to engage with the bottom cover 5. The inner end of 21 the spiral spring 2 is in engagement with the engaging slot 52 of the axle 51 within the interior of the bottom cover 5. The cord-rotating disc 3 has an upper portion, a lower portion and a center hole. The cord-rotating disc 3 is provided at the top portion with a circular flange 36 which is divided into a plurality of sections 37 by a plurality of slots 39. A clamping member 32 is provided on the top portion of the cord-rotating disc 3 behind a section a section 37 to form a passage therebetween and has a plurality of serrated teeth 322 at the inner side against the section 37. The outer end of the spiral spring 2 is bent into a hook 22 to engage with one of the sections 37. When the cord-rotating disc 3 is rotated in clockwise or counter-clockwise direction, the spiral spring 2 will be tightened or loosened. The cord 4 is provided with an enlarged block 40 which divides the cord 4 into a first section 41 and a second section 42. The enlarged block 40 has a plurality of serrated teeth 401 engaged with the serrated teeth 322 of the clamping member 32, 50 that once the enlarged block 40 of the cord 4 is pushed to engage with the clamping member 32 in assembly, the enlarged block 40 cannot be pulled out of the clamping member 32. The first section 41 of the cord 4 is wound around the circular flange 36 of the cord-rotating disc 3. Referring to FIGS. 2, 5 and 6, the second section 42 of the cord 4 extends out of the hole 321 of the cord-rotating disc 3 from the top portion to the bottom portion to connect with any desired connector (not shown).

Referring to FIGS. 2, 5 and 6, the positioning structure 6 comprises a positioning rod 61 and positioning plate 62. The positioning plate 62 covers the top section of the positioning rod 61. The two lateral sides of the positioning plate 62 are engaged with an inner side of the bottom cover 5 by two pegs 60. The positioning plate 62 has a center pivot hole 621 for pivotally mounting of a positioning pivot shaft 611 of the positioning rod 61 such that the positioning rod 61 can rotate with respect to the positioning plate 62. The front end of the positioning rod 61 is provided with a sliding protuberance 612 for correspondingly sliding with the railing grooves 34 at the bottom section of the cord-rotating disc 3.

As shown in FIG. 6, the bottom section of the cord-rotating disc 3 has a railing groove 34 and the positioning rod 61 engages or disengages alternately based on the railing groove 34. Thus, when the cord 4 is pulled, the cord-rotating disc 3 is rotated, and the positioning rod 61 corresponding to the railing groove 34, provides a swinging movement, and the swinging operation allows the pulling of the cord 4 and then the cord 4 is positioned, and another pulling of the cord 4 is allowed when the cord 4 is disengaged with the positioning rod 61.

In another occasion, which is known as gradually positioning mechanism, the cord 4 is pulled and positioned and before the cord 4 is fully retracted, the cord 4 is pulled again, the cord 4 is then engaged. Thus, the positioning structure 6 provides one time positioning of cord 4 or multiple positioning of cord controls.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A single-pull reel comprising:

a bottom cover having a center provided with an axle, said axle having a top end provided with a notch;

a top cover configured to engage with said bottom cover;

a cord-rotating disc having a top portion, a bottom portion and a center hole, said top portion being provided with a circular flange which is divided into a plurality of sections by a plurality of slots, a clamping member being provided on said top portion of said cord-rotating disc to form a passage between said clamping member and one of said sections and having an engaging means at an inner side against said one of said sections, said bottom portion being provided with a railing groove;

a spiral spring having an inner end and an outer end, said inner end being engaged with said notch of said axle of said bottom cover, said outer end being bent into a hook to engage with one of said sections of said cord-rotating disc;

a cord divided into a first section and a second section by an enlarged block, said block having an engaging means engaged with said engaging means of said clamping member, said first section of said cord being wound around said first flange of said cord-rotating disc, said second section of said cord extending out of a hole from said top portion of said cord-rotating disc to said bottom portion of said cord-rotating disc;

a positioning structure including a positioning rod and a positioning plate, said positioning plate covering a top section of said positioning rod, said positioning rod having an end provided with a pivot and another end provided with a sliding protruded section, said sliding protruded section, said sliding protruded section being engaged with said railing slot of said cord-rotating disc, two sides of said positioning plate being secured to an inner side of said bottom by two pegs, said positioning plate having a center pivot hole in which is pivotally mounted said pivot of said positioning rod.

2. The single-pull reel as claimed in claim 1, wherein said engaging means of said clamping member includes first serrated teeth, and said engaging means of said block includes second serrated teeth engageable with said first serrated teeth.

3. The single-pull reel as claimed in claim 1, wherein said clamping member is arranged behind said one of said sections.

* * * * *